United States Patent [19]

Barrett

[11] 4,267,850

[45] May 19, 1981

[54] FROSTING CAP

[76] Inventor: Eileen Barrett, 3613 Orlando Pl., Alexandria, Va. 22305

[21] Appl. No.: 129,658

[22] Filed: Mar. 12, 1980

[51] Int. Cl.[3] ..... A45D 8/40

[52] U.S. Cl. ..... 132/9

[58] Field of Search ..... 132/9

[56] References Cited

U.S. PATENT DOCUMENTS

| | | | |
|---|---|---|---|
| 3,249,113 | 5/1966 | Sobock | 132/9 |
| 3,302,653 | 2/1967 | D'Agostino | 132/9 |
| 3,390,689 | 7/1968 | Newman | 132/9 |

*Primary Examiner*—G. E. McNeill

*Attorney, Agent, or Firm*—Diller, Ramik & Wight

[57] ABSTRACT

This disclosure relates to a frosting cap, particularly adapted for use on long hair (10 inches and above), formed of flexible material, such as plastic or rubber, having an interior and an exterior surface which collectively defines a wall terminating in an upwardly curled rim, a plurality of first apertures disposed through the walls for pulling therethrough groups of hair from an interior of the cap to an exterior thereof whereby each such group of hair can be individually treated and at least one further aperture substantially larger than any-one of the first-mentioned apertures for receiving therethrough a single mass of hair exposed exteriorly of the cap in the manner of a "ponytail" whereby the groups of hair are individually drawn from the mass of hair in an inward direction from the larger aperture along a portion of the interior of the cap and thence outwardly through selected ones of the first apertures incident to treating the individual groups of hair.

7 Claims, 3 Drawing Figures

FIG. 1
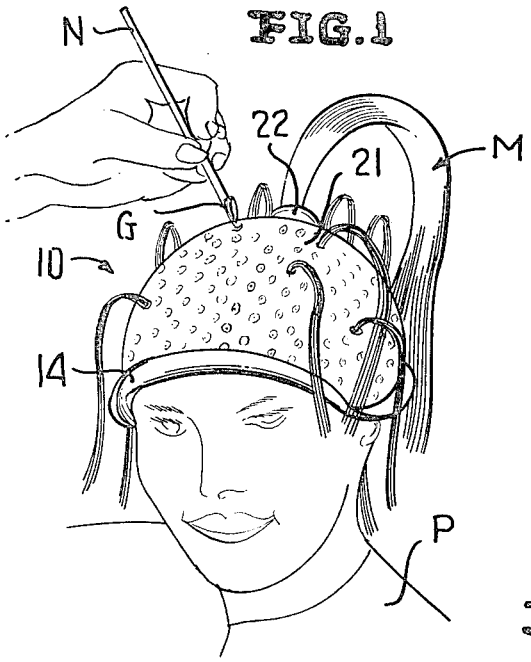
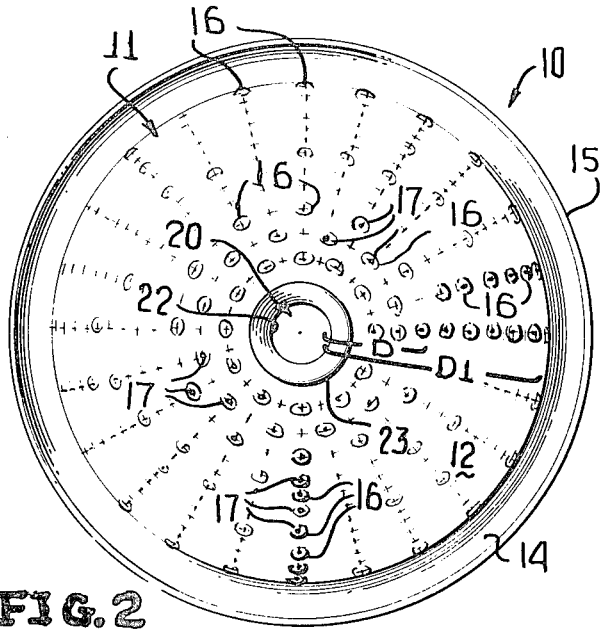
FIG. 2
FIG. 3
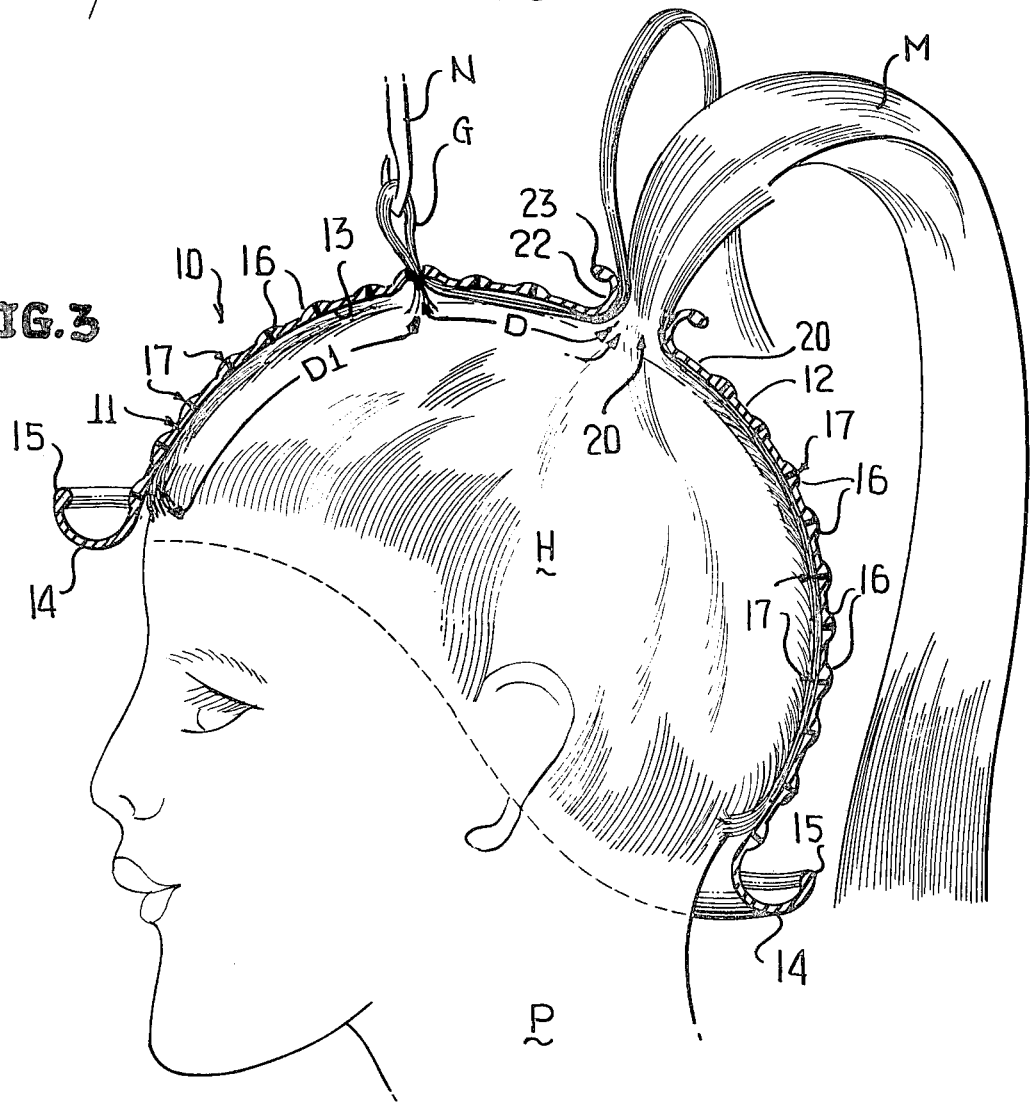

FROSTING CAP

The present invention is directed to a novel device or cap particularly adapted to be utilized during the tinting, frosting, streaking, dying or otherwise treating and/or coloring hair. Such devices are generally referred to as "frosting caps", and more often than not they take the form of a rubber or plastic cap or cover which is placed over the head of an individual and is provided with a plurality of holes or perforations through which strands of hair or groups of hair are pulled through by utilizing crochet needles or the like. Thereafter each group might be individually bleached, colored, "frosted" or as the hair which has not been pulled through such an opening is unaffected by the "frosting", "streaking" or similar treating operation. By constructing a frosting cap such that a mass of hair is generally located at the crown of the head of the person whose hair is being treated, the efficiency of the treating operation is increased by an approximate 50% reduction in time, the overall treatment is effected more uniformly and the pain incident to drawing the hair through the openings is appreciably lessened as compared to the pain involved in drawing or pulling hair through conventional frosting or like caps. Thus, the overall invention is highly novel and advantageous in its concept, structure and utilization.

Applicant considers her frosting cap to be an unobvious improvement over an actual cap she has utilized in her work and which bears thereon U.S. Pat. No. 3,249,113 which a patent issued to one Thomas J. Sobeck. The frosting cap of the latter-noted patent does include a plurality of apertures, holes, openings or the like through which hair may be drawn by utilizing a crochet needle, but the concept and structure of utilizing a relatively large aperture for localizing a mass of hair much in the manner of a "ponytail" from which smaller groups of hair can be drawn is not found in this patent or other patents known to applicant which include, for example, U.S. Pat. Nos.

4,165,754
4,155,369
4,020,854
3,468,318
3,390,689
3,270,753
2,957,480

Thus, none of the patents, latter-noted, singularly nor in combination is considered by applicant to be suggestive of the frosting cap and the method of utilizing the same as is more specifically described hereinafter and recited in the claims herein.

With the above and other objects in view that will hereinafter appear, the nature of the invention will be more clearly understood by reference to the following detailed description, the appended claims and the several views illustrated in the accompanying drawings.

IN THE DRAWINGS

FIG. 1 is a perspective view of a novel frosting device or cap constructed in accordance with this invention, and illustrates the frosting cap atop the head of a person with groups of hair being drawn through selected apertures and a mass of hair projecting outwardly from an enlarged aperture adjacent a crown of the cap.

FIG. 2 is a top plan view of the frosting cap of FIG. 1, and illustrates the plurality of relatively small apertures, the large aperture at the crown and an associated rim for collecting treatment liquid.

FIG. 3 is a sectional view through the cap while in position upon the wearer, and illustrates the manner in which a selected group of hair is withdrawn through one of the plurality of small openings from the mass of hair exiting the larger aperture.

A novel frosting device or cap constructed in accordance with this invention is generally designated by the reference numeral 10 and includes a wall or body 11 having an outer surface 12 and an inner surface 13 of respective, generally convex and concave configurations. The wall 11 terminates at a lower upwardly opening rim 14 having a reinforced bead 15. The rim 14 is designed to collect bleach, dye or similar treating liquid to prevent the same from adversely affecting a person P whose hair H is being frosted, dyed or otherwise treated. Preferably though certainly not necessarily, the outer generally convex surface 12 is provided with a multiplicity of raised portions 16 spaced generally uniformly about the entire wall 11 of the cap 10, as is most readily apparent in FIGS. 1 and 2 of the drawing. Associated with each of the raised and thus reinforced portions 16 are a plurality of first aperture means, each generally designated by the reference numeral 17 which are likewise disposed uniformly about the cap 10 through which relatively small groups G of hair H may be pulled by utilizing a conventional crochet needle N in a known fashion, as will be described more fully hereinafter. Thus far the structure of the frosting device or cap 10 is conventional.

The unobvious improvement over known frosting caps includes in the frosting cap 10 at least one further aperture means, generally designated by the reference numeral 20 located at a central or crown portion 21 of the wall 11 substantially equidistant from the rim 15. The aperture means 20 is defined by a generally annular wall 22 which curves generally upwardly and radially outwardly terminating in a reinforced rim 23. It is through the second relatively large aperture 20 that a mass M of hair generally transformed by the passage therethrough in the form of a "ponytail" is localized exteriorly of the cap 10 incident to the initiation of the frosting, treating or like operation. In other words, when the frosting cap 10 is placed upon the head of the person P substantially all of the person's hair H is drawn through the aperture 20 and forms the mass M of hair exteriorly of the cap 10.

A typical frosting operation is begun by fashioning the hair H of the person P into the mass M and directing the mass M through the aperture 20 while placing the cap 10 upon the person P much in the manner illustrated in FIG. 3. At this point, all of the person's hair H is covered by the frosting cap 10 except for the mass M which has been drawn outwardly of the cap 10 through the aperture 20.

The next step in the process is for the operator to insert a crochet needle N through one of the openings or apertures 17 and grasp a relatively small group G of hair H immediately adjacent the interior surface 13 of the selected opening, as in the manner clearly illustrated in FIG. 3. Crochet needle N of FIG. 3 is then withdrawn back through the associated opening 17 pulling the associated group G of hair from the mass M of hair a distance D which is generally the distance between the aperture 20 and the selected opening 17 through which the needle N was initially inserted and is shown withdrawn in FIG. 3. Thus the group G of hair is drawn a relatively limited distance D along the interior surface 13 of the wall 11 and this reduces the pain involved and the time required for drawing the hair the relatively short distance D, as opposed to relatively longer distances which the same group G would have to be drawn in the absence of the aperture 20. In other words, in the absence of the aperture 20, all of the hair H would project downwardly beyond the rim 14 and if such hair were drawn through the same opening shown associated with the crochet needle N in FIG. 3, some of the hair of the group drawn by the needle N would be necessarily pulled the distance D1 which is appreciably greater than the distance D thus resulting in (1) a longer period of time to draw the hair in a conventional manner from the area of the rim 14 and (2) an appreciably greater amount of pain associated therewith. Furthermore, it has been found that by drawing all of the hair into the mass M at the dome, the hair H is disposed relatively uniformly about the head of the person P and when progressively drawn through the openings 17 in much the manner illustrated in FIG. 1 and thereafter treated, the treatment such as frosting or dying, is much more uniform than if this were accomplished in the absence of the aperture 20 as is conventionally done in the Sobeck patent (U.S. Pat. No. 3,249,113), supra.

Thus, by virtue of the provision of the aperture means 20 for localizing or positioning the mass M of hair adjacent the crown or dome portion 21 of the frosting cap 10 a particular treatment can be (1) accomplished in a lesser period of time (half that of normal) (2) the pain involved is lessened because on average groups of hair are pulled the lesser collective distances, and (3) a more uniform collection of groups G of hair are created thus resulting in a more uniform treating, frosting, dying, streaking or like operation.

Although only a preferred embodiment of the invention has been specifically illustrated and described herein, it is to be understood that minor variations may be made in the apparatus without departing from the spirit and scope of the invention, as defined in the appended claims.

What is claimed is:

1. A frosting device comprising a generally flexible cap adapted to rest upon the head of a person in generally overlying relationship to the hair thereof, a plurality of first aperture means disposed about said cap for pulling therethrough groups of hair from an interior of said cap to an exterior thereof whereby each such group of hair can be individually treated, and at least one further aperture means substantially larger than any one of said plurality of first aperture means for receiving therethrough a single mass of hair disposed exteriorly of said cap whereby said groups of hair are individually drawn from said mass of hair in an inward direction from the cap exterior through said larger aperture means along a portion of said cap interior and thereafter outwardly through selected ones of said first aperture means incident to treating the individual groups of hair exteriorly of the cap.

2. The frosting device as defined in claim 1 wherein said at least one aperture means is disposed at a crown portion of said cap.

3. The frosting device as defined in claim 1 wherein said further aperture means is a relatively large circular opening substantially larger than any of said first aperture means.

4. The frosting device as defined in claim 2 wherein said further aperture means is a relatively large circular opening substantially larger than any of said first aperture means.

5. The frosting device as defined in claim 2 wherein said further aperture means is a generally circular opening of approximately no less than one inch in diameter.

6. A method of treating the hair of a person with a liquid utilizing a frosting cap having a plurality of minute apertures located generally entirely thereabout and at least one relatively larger aperture comprising the steps of placing the cap upon the head of a person with a mass of hair of the latter passing through the larger aperture in generally a ponytail fashion exterior of the cap, drawing through one of the smaller apertures a group of hair from the mass of hair in an inward direction from the cap exterior through the larger aperture along a portion of the cap interior and thereafter outwardly through the selected first aperture, and thereafter treating the so withdrawn group of hair.

7. The method as defined in claim 6 including the step of repeating the last two steps utilizing others of the minute apertures until the mass of hair has been substantially reduced.

* * * * *